United States Patent [19]

Pausch

[11] Patent Number: 4,805,841

[45] Date of Patent: Feb. 21, 1989

[54] METHOD AND APPARATUS FOR FEEDING GRINDING BODIES TO A GRINDING AREA

[75] Inventor: Horst Pausch, Schwarzenbach, Fed. Rep. of Germany

[73] Assignee: Gebrüder Netzsch Maschinenfabrik GmbH & Co., Selb, Fed. Rep. of Germany

[21] Appl. No.: 87,606

[22] Filed: Aug. 20, 1987

[30] Foreign Application Priority Data

Aug. 29, 1986 [DE] Fed. Rep. of Germany ..... 3629421

[51] Int. Cl.[4] ..... B02C 17/18

[52] U.S. Cl. ..... 241/30; 241/171

[58] Field of Search ..... 241/30, 171, 172, 34

[56] References Cited

U.S. PATENT DOCUMENTS 4,558,825 12/1985 John et al. ..... 241/171

FOREIGN PATENT DOCUMENTS 2242174 8/1972 Fed. Rep. of Germany .

3437299 10/1984 Fed. Rep. of Germany .

OTHER PUBLICATIONS

European Patent Application, 0074633, 3-83.

*Primary Examiner*—Mark Rosenbaum

*Attorney, Agent, or Firm*—William H. Elliott, Jr.; Richard L. Hansen

[57] ABSTRACT

In continuous operation of agitator mills, in particular when processing abrasive products, which operate with grinding bodies (35) in a grinding area, worn grinding bodies must be replaced. A grinding body feed device (9) which can be used for grinding bodies (35) of different shape and size comprises an intermediate chamber (43) from which the grinding bodies (35) pass from a storage vessel (33) into the grinding area without any material being ground getting into the storage vessel (33). The intermediate chamber (43) can be shut off at its inlet and its outlet in each case by means of a valve (19, 41; 47, 49), one of which is always closed during the introduction of grinding bodies (35) into a product supply pipe (45) leading to the grinding area.

9 Claims, 4 Drawing Sheets

METHOD AND APPARATUS FOR FEEDING GRINDING BODIES TO A GRINDING AREA

The invention relates to a method and apparatus for proportioned feeding of grinding bodies, for example grinding balls, from a storage vessel to the grinding area of an agitator mill, the grinding bodies passing through an intermediate chamber.

In particular when fine grinding ferrites or similar abrasive materials in an agitator mill the grinding bodies in the area are subject to considerable wear. The wear manifests itself by changes in the degree of fineness of the ground product. To keep the degree of fineness of the end product constant and achieve continuous operation of the agitator mill, during the grinding grinding bodies must be fed to the grinding area. This can be made difficult by a slight excess pressure which generally obtains in closed agitator mills, and the sealing of the grinding area with respect to the storage vessel to prevent penetration of ground material into the storage vessel. Material to be ground in the storage vessel causes agglomerations of grinding bodies and thus prevents the trouble-free replenishing flow of grinding bodies.

German patent application publication No. 2,242,174 discloses for feeding grinding bodies to the grinding area of an agitator mill a device having a housing disposed between storage vessel and grinding area and a drivable conveying member disposed therein. In this device the housing has a cylindrical bore which opens into the grinding area and the diameter of which is somewhat smaller than the diameter of the grinding bodies. The wall of the bore is resilient so that the grinding bodies can be pressed in succession through the bore and at all times at least one grinding body tightly seals the bore. As conveying member a piston is disposed in a portion of the bore remote from the grinding area, said piston being reciprocatable by a crank drive so that by strokes it exerts a force on the rearmost grinding body which is transmitted through a plurality of grinding bodies lying one behind the other in the bore so that in each case the foremost grinding body is pushed into the grinding area. On each return stroke the piston frees the opening of a line through which a fresh grinding body falls from the storage vessel into the bore.

It has been found that this known device operates reliably only when the grinding bodies are all of the same size and have approximately an exact spherical form. These conditions are fulfilled only by new and well-sorted grinding bodies; used grinding bodies cannot be fed again by means of the known device into the grinding area.

An apparatus for feeding grinding bodies which also permits re-use of used grinding bodies is known from U.S. Pat. No. 4,558,825 (John et al.). In a tubular connecting piece between a grinding vessel and a storage vessel for grinding bodies a conveying member is disposed in the form of a rotatably drivable worm. Although the inner cross-section of the connecting piece widens in the direction of the grinding area or the worm core in the same direction is made to taper conically and thereby a backflow of grinding bodies against the inlet direction is inhibited, the worm does not perform the function of a seal between the grinding vessel and the storage vessel for material to be ground so that when working certain materials (e.g. calcium carbonate) agglomerations of ground material and grinding bodies can occur in the storage vessel and interfere with the continuous feeding of grinding bodies.

A further device for introducing grinding bodies, in particular into a tube mill subjected to elevated pressure, is known from German patent application publication No. 3,437,299.

A shutoff slide valve member, which provides a gastight seal, is provided in a drop tube between a charging vessel and the grinding area. A transversely displaceable air piston connects to the drop tube above the valve member. Although it is possible to introduce grinding bodies into the charging vessel even though the pressure is changing, during such introduction the charging vessel is in connection with the grinding area. Consequently, continuous operation of the device is not possible.

The problem underlying the invention is to further develop an agitator mill so that a trouble-free feeding of grinding bodies of any form is possible from a storage vessel with continuous operation of the agitator mill without the material being ground being able to penetrate the storage vessel.

This problem, in so far as it concerns a method, is solved according to the invention in that of two shutoff means arranged at the intermediate chamber on the inlet and outlet side the shutoff means on the outlet side is closed on feeding grinding bodies from the storage vessel and the shutoff means on the inlet side is closed on dispensing grinding bodies in the direction to the grinding area. As regards the apparatus, this problem is solved in that the intermediate chamber is constructed for receiving an irregular bulk charge of grinding bodies and is provided at its inlet and outlet with controllable shutoff means.

Thus, according to the invention the grinding bodies are taken from a storage vessel, introduced into an intermediate chamber sealed with respect to the grinding area and from said chamber pass into the grinding area after said intermediate chamber has been sealed with respect to the storage vessel.

Advantageous further developments of the invention are set forth in the subsidiary claims.

Examples of embodiment of the invention will be described in detail hereinafter with the aid of schematic drawings, wherein.

Figure 1:
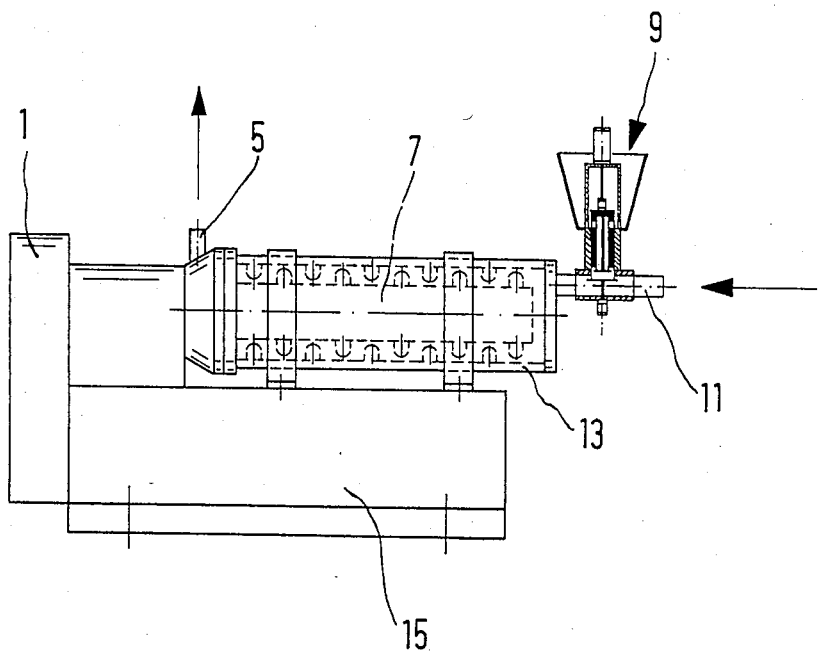
FIG. 1 shows a horizontal agitator mill comprising a device according to the invention for feeding grinding bodies.

In FIG. 1 the essential parts of a horizontal agitator mill having a grinding body feed device 9 according to the invention are shown. The agitator mill has a drive which is not shown and via an infinitely variable transmission 1 drives an agitating shaft 7 in a grinding vessel 13. The grinding vessel 13 is mounted on a support 15 which contains the drive. Between the inner wall of the grinding vessel 13 and the agitating shaft 7 a grinding area or space is formed which contains grinding bodies. The grinding bodies pass from the grinding body feed device 9 through a product inlet into the grinding area.

The completely worked product leaves the grinding vessel 13 through a product outlet 5.

Figure 2:
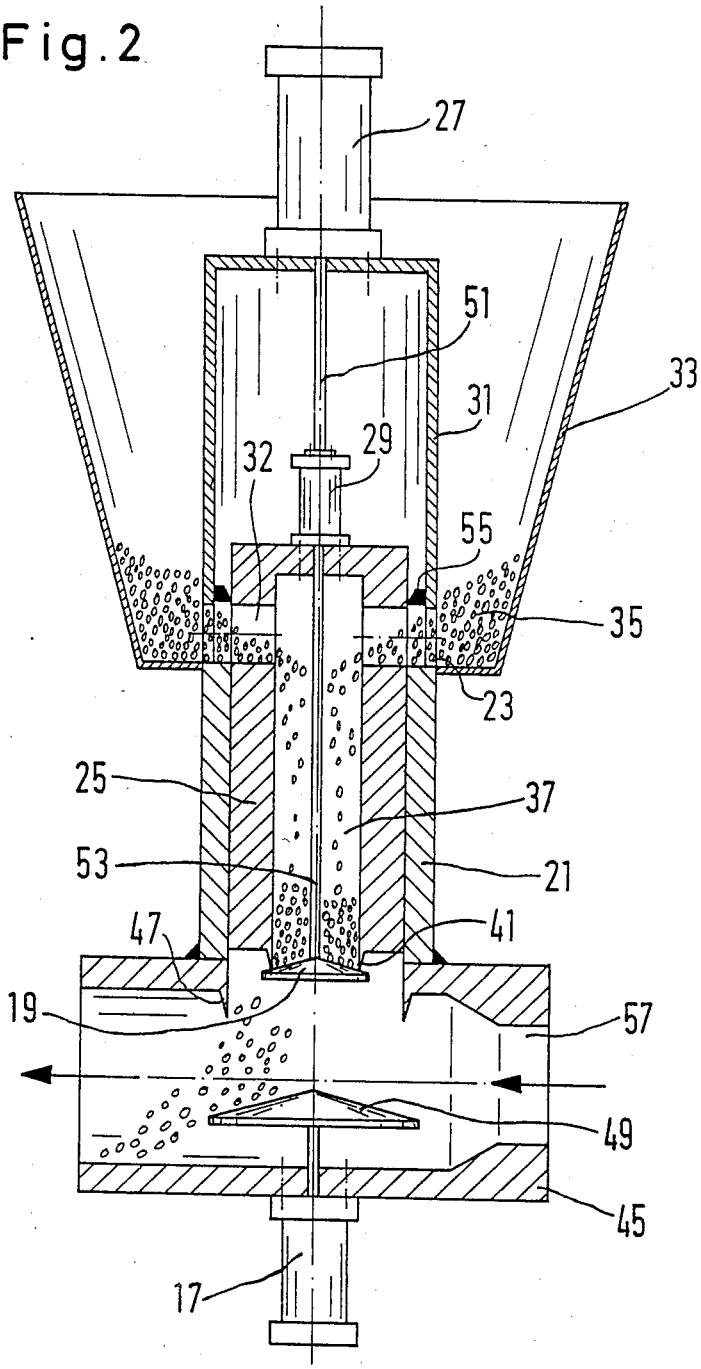
FIG. 2 is a vertical longitudinal section drawn to a larger scale through the device according to the invention during a first phase of a replenishment operation.
Figure 3:
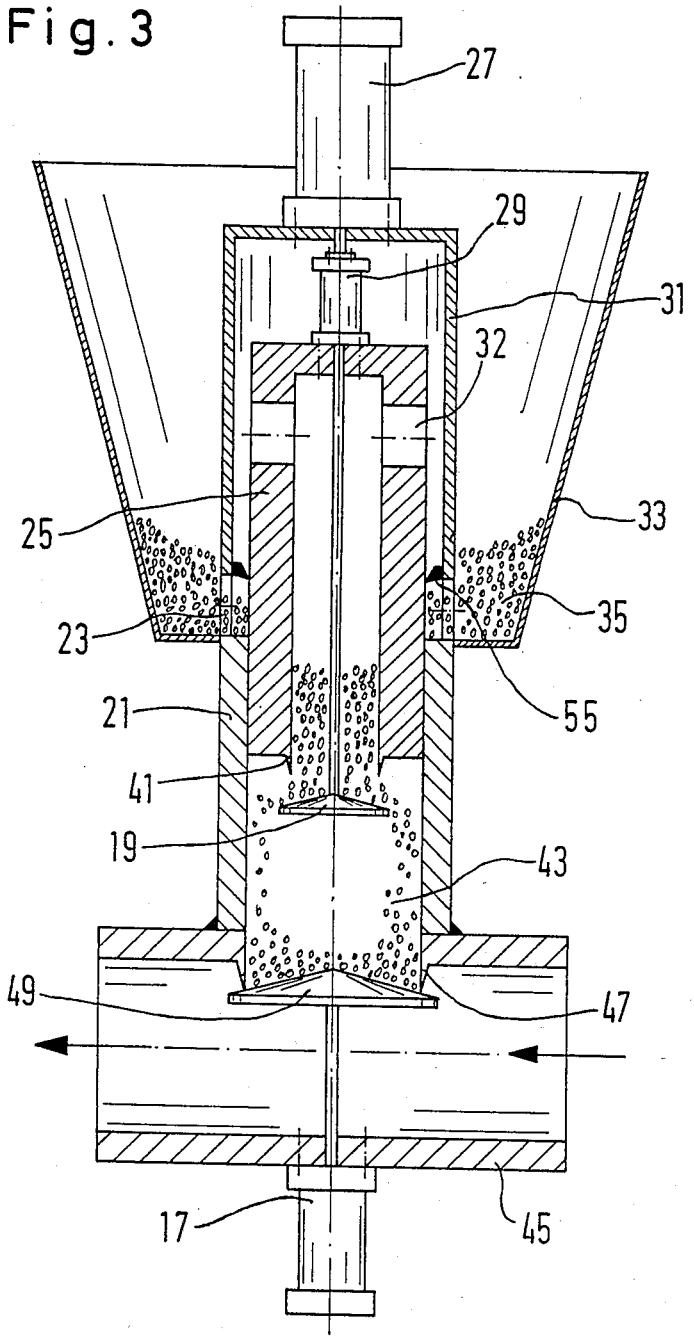
FIG. 3 shows the same device in a second phase of the replenishment operation and FIG. 4 shows a modified embodiment of the device according to the invention in an operating phase corresponding to FIG. 3.

FIGS. 2 and 3 show the feeding of grinding bodies to a pipe 45 which forms a portion of the product inlet 11 and through which unground product thus also reaches the grinding vessel 13. Opening from above into the pipe 45 is a tubular extension 21 on which a hood 31 is secured. In the extension 21 a piston-like slide 25 is disposed which surrounds a proportioning chamber 37. The proportioning chamber 37 is bordered at the outlet side by a valve seat 41 formed at the lower end of the slide 25. Associated with the valve seat 41 is a conical valve body 19 which is mounted at the lower end of a piston rod 53 and in the position of FIG. 2 bears sealingly on the valve seat 41.

In the position of FIG. 2 the proportioning chamber 37 is connected by passages 32 disposed near its upper end and openings 23 in the hood 31 lying at the same level to a storage vessel 33. Directly above the openings 23 at the inner side of the hood 31 a lip seal 55 is disposed which bridges a narrow annular gap between hood 31 and slide 25. In the position according to FIG. 2 grinding bodies 35 can trickle from the storage vessel 33 into the proportioning chamber 37. The amount of grinding bodies thus reaching the proportioning chamber 37 depends on the time for which the position of FIG. 2 is retained. This time may for example be set at a time relay.

At an opening of the extension 21 into the pipe 45 beneath the position which the valve body 19 assumes according to FIG. 2 a further valve seat 47 is formed with which a conical valve body 49 is likewise associated. The two valve bodies 19 and 49 point with their cone tip vertically upwardly and are so steep that grinding bodies 35 cannot remain lying thereon when the respective valve body does not sealingly engage its valve seat 41 and 47.

The valve bodies 19 and 49 and the slide 25 can be moved up and down by means in each case of a piston-cylinder unit 29, 17 and 27 respectively. The piston-cylinder unit 27 comprises a cylinder secured to the hood 31 and a piston rod 51 which extends through the hood 31 and is secured to a cylinder which belongs to the piston-cylinder unit 29 and in turn is mounted on the slide 25. Between the valve formed by the valve seat 47 and the valve body 49 and the slide 25 an intermediate chamber 43 is provided.

FIG. 3 shows the refilling of the intermediate chamber 43 with grinding bodies 35 from the proportioning chamber 37. The slide 25 here is in its upper end position. In the narrow gap between the hood 31 and the slide 25 a grinding body buildup then forms which is limited upwardly by the sealing lip 55. This prevents the further trickling of grinding bodies 35 through the passages 32. When the lower valve 47, 49 is closed the upper valve 19, 41 is open and the grinding bodies 35 trickle from the proportioning chamber 37 into the intermediate chamber 43.

Thereafter the piston-cylinder unit 29 closes the upper valve 19, 41 and thereupon the piston-cylinder unit 27 moves the slide 25 downwardly so that the slide 25 and the bottom of the valve body 19 press the grinding bodies 35 into the pipe 45 in which product to be ground flows in the direction of the arrows to the grinding vessel 13. To support the passage of the grinding bodies 35 from the intermediate chamber 43 into the pipe 45 when the valve 47, 49 is open in accordance with FIG. 2 a turbulent flow of material to be ground can be generated by a pipe constriction 57.

When the slide 25 has discharged the intermediate chamber 43 the valve 47, 49 closes and only then does the slide 25 begin to move upwardly. As a result there is no possibility of the slide on its upward movement of sucking the material to be ground into the intermediate chamber 43.

Figure 4:
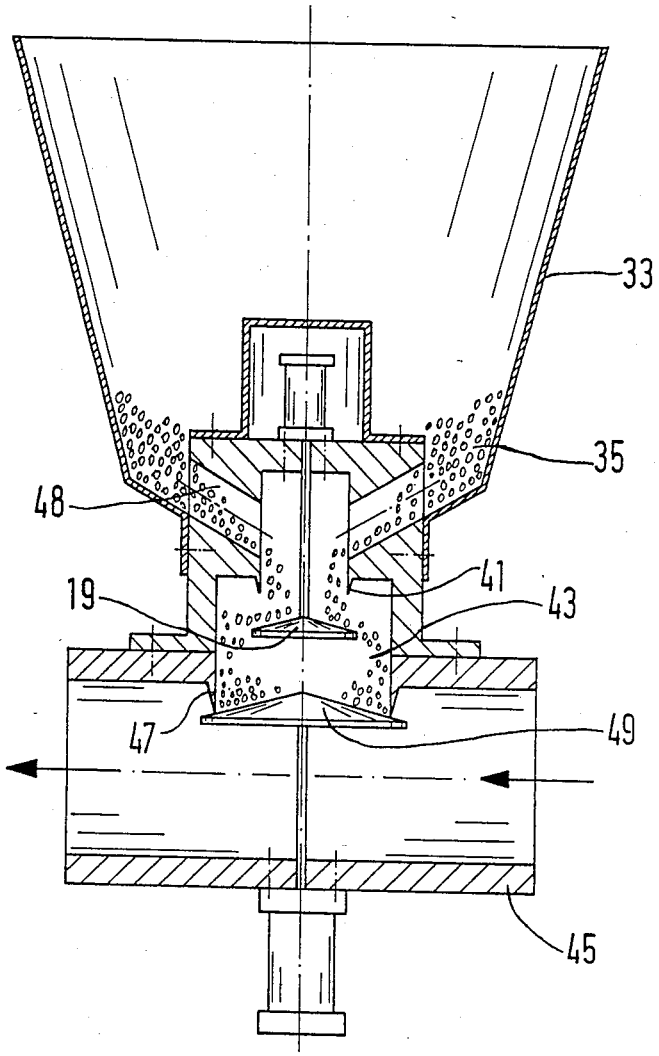

FIG. 4 shows a simplified replenishment device in which the grinding bodies 35 pass from the intermediate chamber 43 into the pipe 45 solely by the action on said bodies of gravity and the suction of the material to be ground flowing through the pipe 45. Likewise by the action of gravity thereon and if desirable with additional support by vibration or liquid pressure the grinding bodies 35 in this embodiment can pass from the storage vessel 33 through downwardly inclined passages 48 into the intermediate chamber 43. The discharging of the grinding bodies 35 from the intermediate chamber 43 into the pipe 45 can also be supported by liquid or fluid pressure, for example by introducing a solution into the intermediate chamber 43 when the valve 19, 41 is closed.

What is claimed is:

1. A method of feeding grinding bodies to the grinding area of an agitator mill which comprises (a) providing apparatus which includes a storage vessel for grinding bodies;

an intermediate chamber having an inlet to receive an irregular charge of grinding bodies from said storage vessel and an outlet to discharge grinding bodies to the grinding area;

a proportioning chamber communicating between said storage vessel and said intermediate chamber;

a first controllable valve means in said inlet;

a second controllable valve means in said outlet; together with means for controlling said first and second valve means;

(b) controlling said first and second valve means to feed grinding bodies to the grinding area; and (c) passing grinding bodies from said storage vessel to said proportioning chamber, thereby preproportioning the grinding bodies.

2. The method of claim 1, wherein said first valve is not opened until said second valve is closed.

3. The method of claim 1, wherein the grinding bodies after leaving the intermediate chamber are supplied to a product inlet and reach the grinding area through a product stream with which product to be ground is fed to the agitator mill.

4. Apparatus for feeding grinding bodies to the grinding area of an agitator mill which comprises a storage vessel for grinding bodies;

an intermediate chamber having an inlet to receive an irregular charge of grinding bodies from said storage vessel and an outlet to discharge grinding bodies to the grinding area;

a proportioning chamber communicating between said storage vessel and said intermediate chamber;

a first controllable valve means in said inlet;

a second controllable valve means in said outlet; together with means for controlling said first and second valve means.

5. The apparatus of claim 4, further comprising shut-off means at an inlet of the proportioning chamber disposed at the end face of a slide which is adapted to be introduced into and withdrawn from the proportioning chamber.

6. The apparatus of claim 5, wherein the shutoff means at the end face of the slide simultaneously with said first valve means seals the outlet of said proportioning chamber.

7. The apparatus of claim 5, wherein the outlet of the intermediate chamber opens into a pipe for the product supply.

8. The apparatus of claim 5, wherein the storage vessel has a conical annular trough in the center of which the slide is guided for up and down sliding motion and passages in the slide when the proportioning chamber is being filled lie radially opposite openings of the storage vessel.

9. The apparatus of claim 4, wherein the proportioning chamber has a smaller volume than the intermediate chamber.

* * * * *